US009745156B2

(12) United States Patent
Kohama

(10) Patent No.: US 9,745,156 B2
(45) Date of Patent: Aug. 29, 2017

(54) SHEET FEED CASSETTE MONITOR THAT HIGHLY ACCURATELY DETECTS OPEN/CLOSE STATE OF SHEET FEED CASSETTE AND PRESENCE/ABSENCE STATE OF PAPER SHEET, IMAGE FORMING APPARATUS, AND SHEET FEED CASSETTE MONITORING METHOD

(71) Applicant: Kyocera Document Solutions Inc., Osaka (JP)

(72) Inventor: Atsushi Kohama, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/081,894

(22) Filed: Mar. 27, 2016

(65) Prior Publication Data

US 2016/0279979 A1 Sep. 29, 2016

(30) Foreign Application Priority Data

Mar. 27, 2015 (JP) ..... 2015-065752

(51) Int. Cl.
*B65H 7/14* (2006.01)
*B65H 1/26* (2006.01)

(52) U.S. Cl.
CPC ..... *B65H 1/266* (2013.01); *B65H 7/14* (2013.01); *B65H 2405/141* (2013.01); *B65H 2405/31* (2013.01); *B65H 2405/32* (2013.01); *B65H 2511/51* (2013.01); *B65H 2511/515* (2013.01);

(Continued)

(58) Field of Classification Search
CPC B65H 7/14; B65H 2405/31; B65H 2405/141; B65H 2405/32; B65H 2220/03; B65H 2553/412; B65H 1/266
See application file for complete search history.

(56) References Cited

U.S. PATENT DOCUMENTS 5,897,112 A * 4/1999 Kwag ..... G03G 15/6502 271/111
6,244,588 B1 * 6/2001 Tsubakimoto ..... B65H 1/266 271/162

(Continued)

FOREIGN PATENT DOCUMENTS

JP 06-048612 A 2/1994
JP 2005-082295 A 3/2005

*Primary Examiner* — Patrick Cicchino
(74) *Attorney, Agent, or Firm* — James Judge

(57) ABSTRACT

A sheet feed cassette monitor includes an actuator with another end portion, a detecting circuit, a plurality of protrusions, a signal monitoring circuit, and a signal determining circuit. When the one end portion is in contact with a paper sheet, the other end portion swings in a first direction. When the one end portion is not in contact with the paper sheet, the other end portion swings in a second direction opposite direction to the first direction. The detecting circuit detects the swinging of the other end portion on the actuator. The plurality of protrusions are convexly installed in an asymmetric manner with respect to a putting-in/taking-out direction of the feed cassette. The signal determining circuit determines a presence/absence state of the paper sheet housed in the sheet feed cassette and an open/close state of the sheet feed cassette based on a pattern of change in the monitored signal.

5 Claims, 21 Drawing Sheets

(52) U.S. Cl.
CPC .... *B65H 2515/70* (2013.01); *B65H 2553/412* (2013.01); *B65H 2553/612* (2013.01)

(56) References Cited

U.S. PATENT DOCUMENTS

| | | | | |
|---|---|---|---|---|
| 8,047,527 | B2 * | 11/2011 | Adachi | B65H 1/04 271/157 |
| 8,608,153 | B2 * | 12/2013 | Ro | B65H 1/266 271/9.11 |
| 8,695,967 | B2 * | 4/2014 | Fujita | B65H 1/266 271/126 |
| 8,790,026 | B2 * | 7/2014 | Hirate | B41J 11/0025 271/265.01 |
| 9,359,156 | B2 * | 6/2016 | Shimazu | B65H 1/14 |
| 2015/0274461 | A1 * | 10/2015 | Ota | B65H 5/068 271/265.02 |

* cited by examiner

SHEET FEED CASSETTE MONITOR THAT HIGHLY ACCURATELY DETECTS OPEN/CLOSE STATE OF SHEET FEED CASSETTE AND PRESENCE/ABSENCE STATE OF PAPER SHEET, IMAGE FORMING APPARATUS, AND SHEET FEED CASSETTE MONITORING METHOD

INCORPORATION BY REFERENCE

This application is based upon, and claims the benefit of priority from, corresponding Japanese Patent Application No. 2015-065752 filed in the Japan Patent Office on Mar. 27, 2015, the entire contents of which are incorporated herein by reference.

BACKGROUND

Unless otherwise indicated herein, the description in this section is not prior art to the claims in this application and is not admitted to be prior art by inclusion in this section.

From a perspective of enhancing a user's convenience, an image forming apparatus, such as a printer, a copier, and a multi-functional peripheral, includes the following functions. That is, the functions include: a function to detect an open/close state of a sheet feed cassette, which houses paper sheets, and a function to detect presence/absence of the paper sheets inside the sheet feed cassette. However, to provide the above-described functions, individually mounting sensors, such as a push switch and a photo interrupter (PI), for each function is required. This causes a problem of cost increase.

In association with recent heated cost competitions, the image forming apparatus omits the sensors. This restricts the above-described functions and supplements the functions by other simple functions. For example, the function to detect the presence/absence of paper sheets inside the sheet feed cassette is replaced by, for example, the following simple function. That is, when a paper feeding operation from the sheet feed cassette is performed first but paper feeding cannot be performed, the function is replaced by a simple function such as displaying a message for a user to replenish paper sheets.

Meanwhile, as a method for ensuring cost reduction while ensuring the above-described functions, for example, the following mechanism has been disclosed. By detecting two states by one sensor, both an open/close state of a sheet feed cassette and presence/absence of paper sheets are detected.

SUMMARY

A sheet feed cassette monitor according to one aspect of the disclosure monitors a sheet feed cassette. The sheet feed cassette includes an actuator, a detecting circuit, a plurality of protrusions, a signal monitoring circuit, and a signal determining circuit. The actuator includes one end portion and another end portion. The one end portion is in contact with an uppermost layer of paper sheets housed in the sheet feed cassette. When the one end portion is in contact with the paper sheet with the sheet feed cassette mounted to an installation box, the other end portion swings in a first direction. When the one end portion is not in contact with the paper sheet, the other end portion swings in a second direction. The second direction is a direction opposite to the first direction. The detecting circuit is located on the installation box side. The detecting circuit detects the swinging of the other end portion on the actuator. The plurality of protrusions are convexly installed in an asymmetric manner with respect to a putting-in/taking-out direction of the feed cassette. The protrusions are located on a far-side in the putting-in/taking-out direction of the sheet feed cassette with respect to a position of the other end portion on the actuator. The signal monitoring circuit monitors a signal from the detecting circuit. The signal determining circuit determines a presence/absence state of the paper sheet housed in the sheet feed cassette and an open/close state of the sheet feed cassette based on a pattern of change in the monitored signal.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
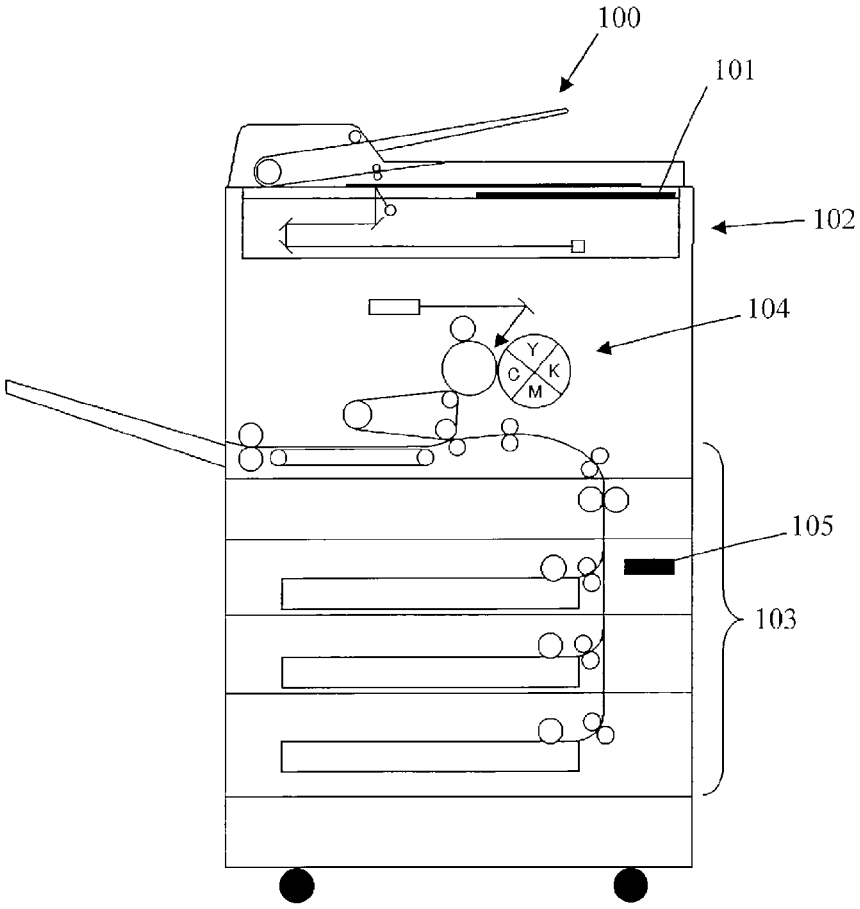
FIG. 1 conceptually illustrates an overall configuration of an image forming apparatus that includes a sheet feed cassette monitoring unit according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes embodiments of a sheet feed cassette monitor, an image forming apparatus, and a sheet feed cassette monitoring method according to the disclosure with reference to the attached drawings for understanding of the disclosure. The following embodiments are merely exemplary embodiments according to the disclosure and do not intend to limit the technical scope of the disclosure. The alphabets S attached before numerals in the flowcharts mean steps.

The following describes an image forming apparatus that includes a sheet feed cassette monitoring unit as one example of the embodiments of the disclosure. For example, as the image forming apparatus, a multi-functional peripheral (MFP) 100 that includes a function such as a facsimile, a copy, a scanner, or a printer, and furthermore a copier, a printer, or a similar device is applicable.

As illustrated in FIG. 1, the image forming apparatus 100 accepts setting conditions of jobs from a user via an operation unit 101. The job includes, for example, copy, facsimile, scan, and print. When the image forming apparatus 100 accepts the setting conditions of the job, the image forming apparatus 100 drives respective units of an image reading unit 102, a paper sheet conveyor 103, an image forming unit 104, or a similar unit to execute these jobs. The image reading unit 102 reads images on a document placed on a platen or an automatic document feeding unit. The paper sheet conveyor 103 conveys a paper sheet from a sheet feed cassette or a bypass tray to the image forming unit 104. The image forming unit 104 transfers toner images corresponding to the images on the document to the conveyed paper sheet and fixes the toner images by a fixing roller to perform image formation.

Here, the image forming apparatus 100 houses a sheet feed cassette monitoring unit 105. The sheet feed cassette monitor unit 105 monitors presence/absence state of a paper sheet housed in the sheet feed cassette and the (attached/detached) state of the sheet feed cassette and displays a screen according to the state of this sheet feed cassette to the user via the operation unit 101.

Control circuits (not illustrated) of the image forming apparatus 100 and the sheet feed cassette monitoring unit 105 connect a central processing unit (CPU), a read only memory (ROM), a random access memory (RAM), a hard disk drive (HDD), a solid state drive (SSD), and drivers corresponding to respective driving units by an internal bus.

For example, the CPU operates as follows: executing programs stored in the ROM, the HDD, the SSD, or a similar device using the RAM as a work area; receiving and transmitting data, instructions, signals, commands, and similar information from the drivers based on this execution result; controlling operations of the respective driving units regarding the execution of the job. Regarding respective units (illustrated in FIG. 2), which will be described later, other than the driving units, the CPU also achieves these respective units by executing the programs. The ROM, RAM, HDD, SSD, and a similar device store the programs and data that achieve the respective units described below.

Figure 2:
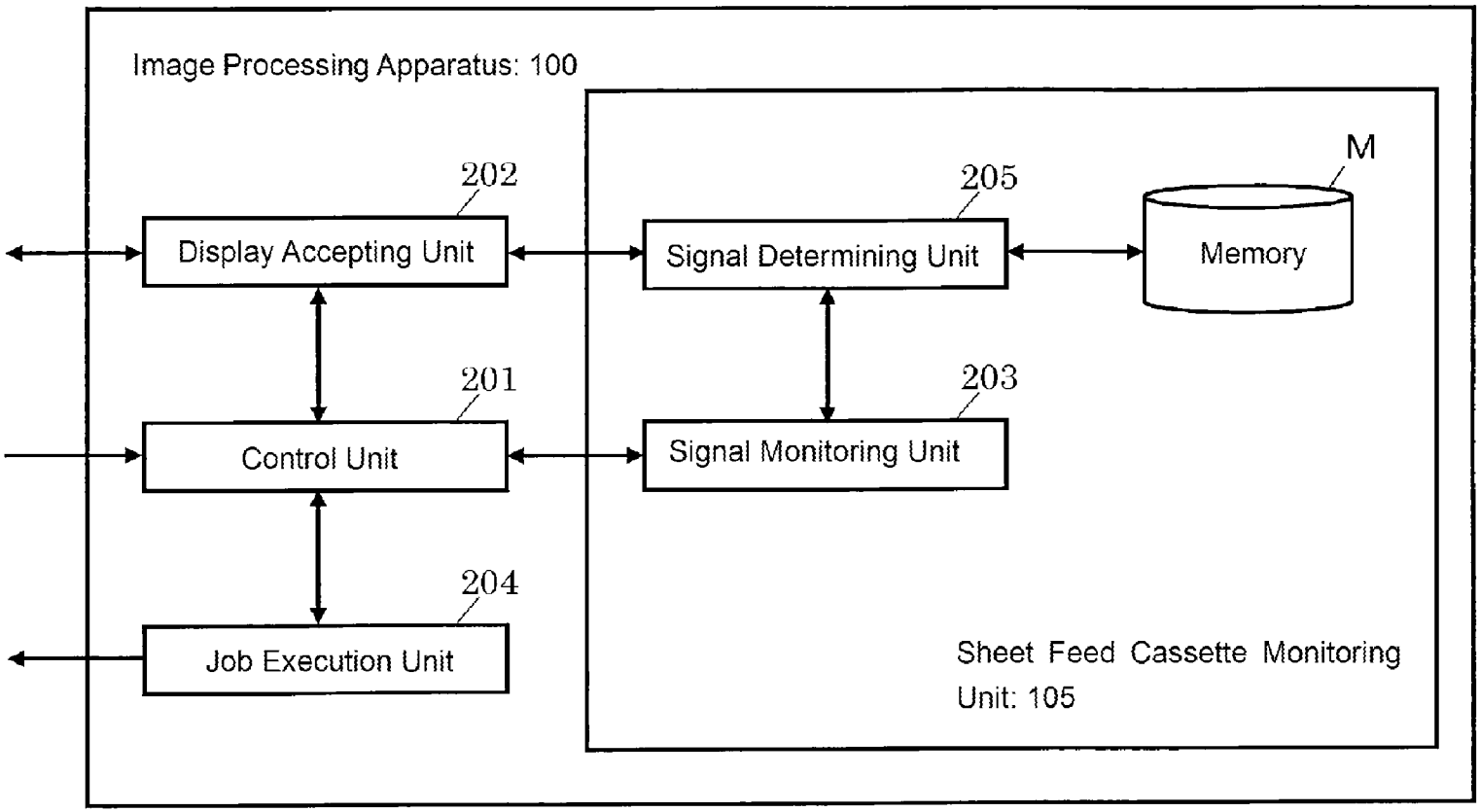
FIG. 2 illustrates a function block of the image forming apparatus that includes the sheet feed cassette monitoring unit according to the one embodiment.
Figure 3:
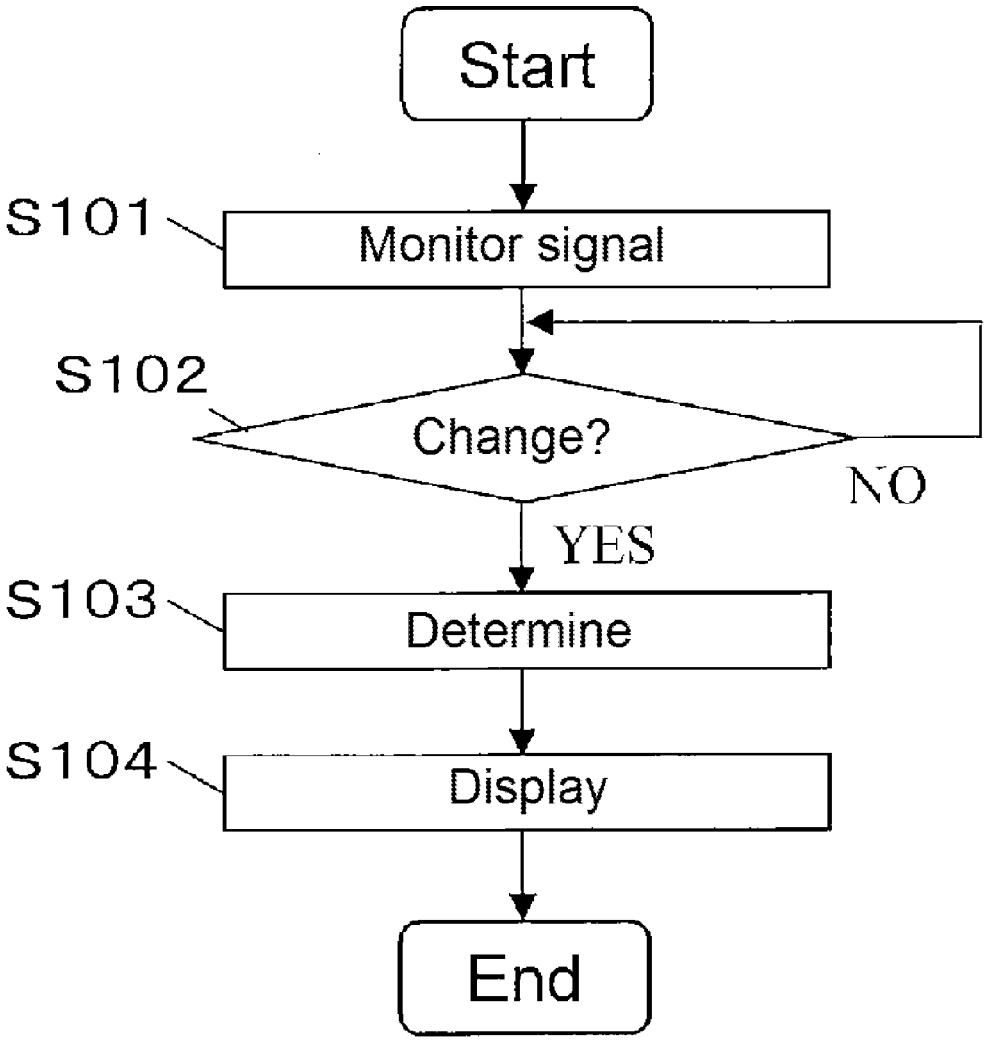
FIG. 3 illustrates an execution procedure according to the one embodiment.

The following describes configurations and execution procedures according to the embodiments of the disclosure with reference to FIGS. 2 and 3. When the user powers on the image forming apparatus 100, a control unit 201 of this image forming apparatus 100 starts. The control unit 201 notifies a display accepting unit 202 (also referred to as a display accepting circuit) of the start. The display accepting unit 202 receiving this notification displays an operation screen on a touch panel of the operation unit 101.

The control unit 201 notifies the sheet feed cassette monitoring unit 105 of the start. The sheet feed cassette monitor unit 105 receiving this notification monitors the presence/absence state of paper sheets housed in the sheet feed cassette and the open/close state of the sheet feed cassette.

Figure 4A:
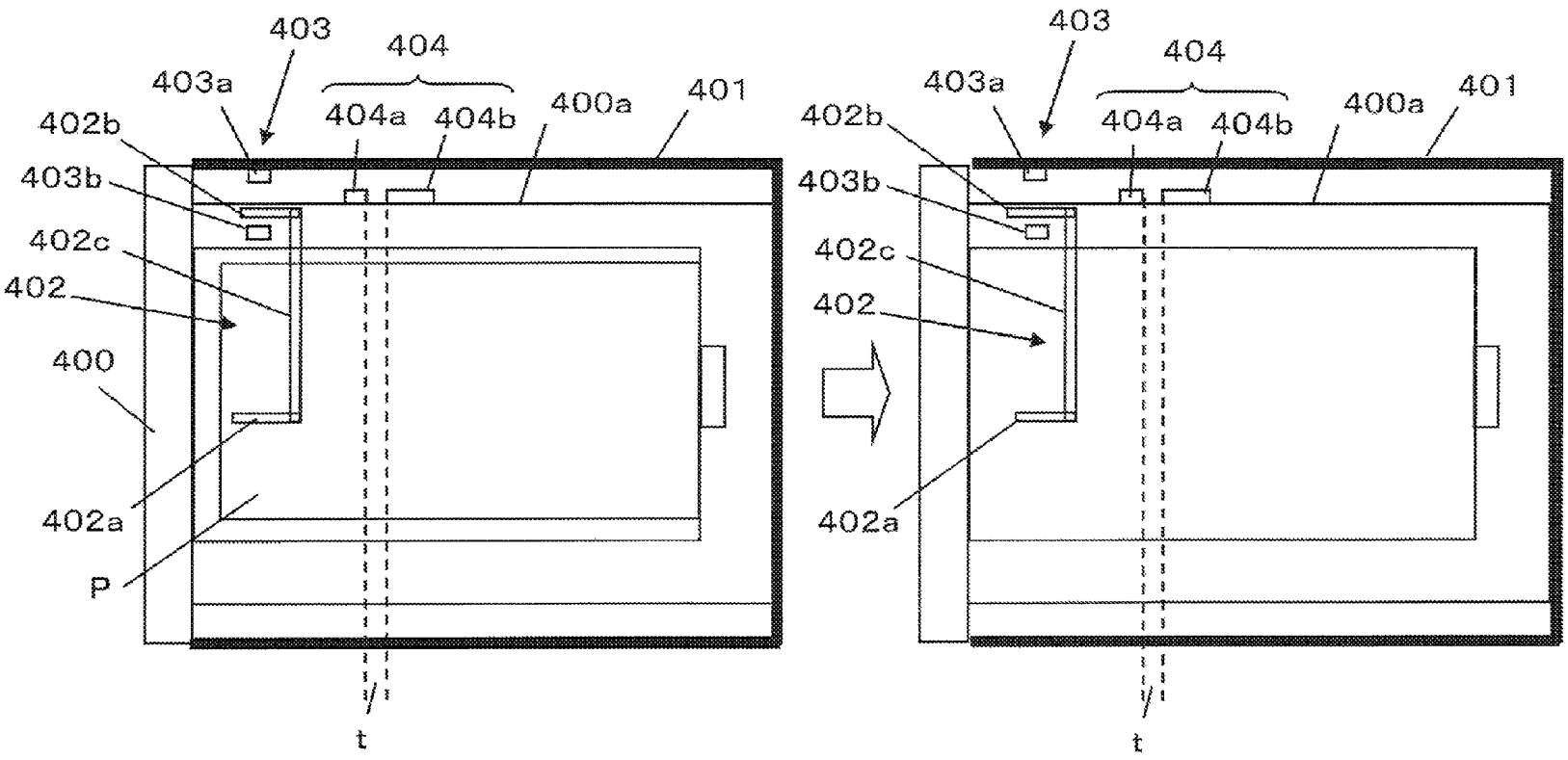
FIG. 4A illustrates an example of cross sections of a plane of a sheet feed cassette according to the one embodiment.
Figure 4B:
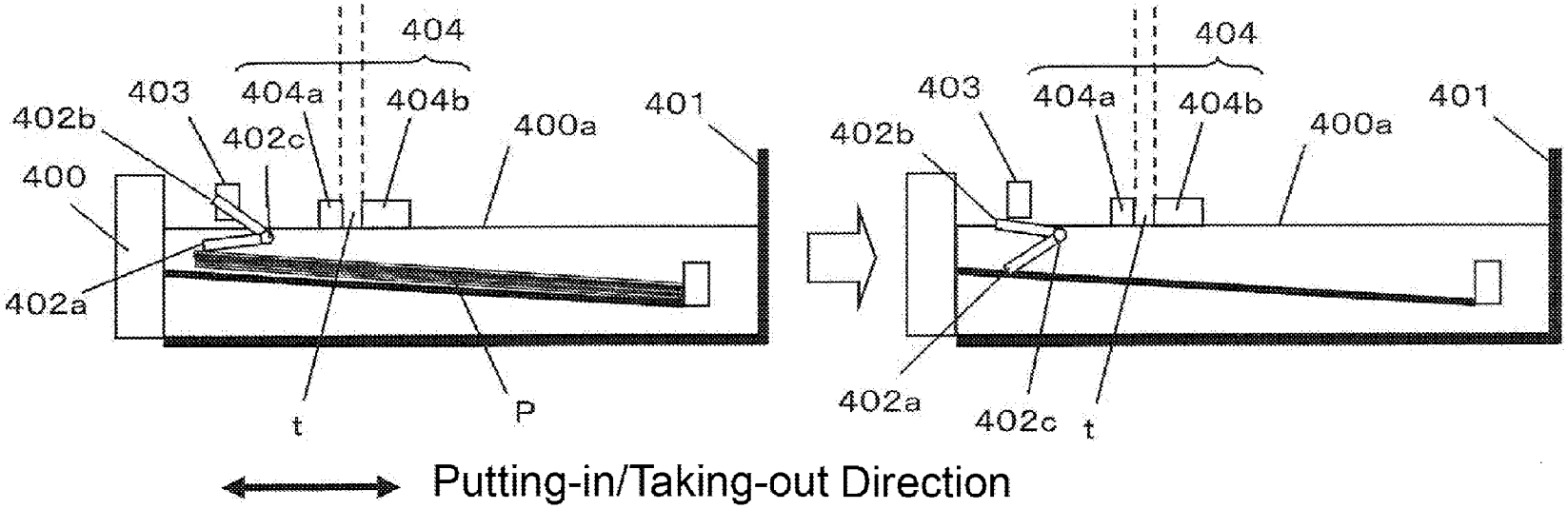
FIG. 4B illustrates an example of cross sections of a side surface of the sheet feed cassette according to the one embodiment.

For example, as illustrated in FIGS. 4A and 4B, the main body of the image forming apparatus 100 includes an installation box 401 to/from which a sheet feed cassette 400 is attachable and removable. This sheet feed cassette 400 includes an actuator 402. The actuator 402 is turnably supported to an inside of one side surface 400*a*, which is located in a putting-in/taking-out direction (an open/close direction) of this sheet feed cassette 400. The actuator 402 includes one end portion 402*a* and the other end portion 402*b*. The one end portion 402*a* is in contact with the uppermost layer of the paper sheets P housed in the sheet feed cassette 400. When the one end portion 402*a* is in contact with the paper sheet P with the sheet feed cassette 400 mounted to the installation box 401, the other end portion 402*b* swings in a first direction (for example, upward). When the one end portion 402*a* is not in contact with the paper sheet P, the other end portion 402*b* swings in a second direction (downward), which is a direction opposite to the first direction.

For example, the actuator 402 has a U shape formed by orthogonally bending the one end portion 402*a* and the other end portion 402*b* of long bars in a longitudinal direction. A main unit 402*c*, which is located at the longitudinal direction of the actuator 402, serves as a swinging rotation shaft and is rotatably journaled to the one side surface 400*a* on the sheet feed cassette 400. Viewed from the longitudinal direction of the main unit 402*c* of the actuator 402, the one end portion 402*a* and the other end portion 402*b* are bent at different angles.

A detecting unit 403 (also referred to as a detecting circuit) is located on the installation box 401 side of the image forming apparatus 100. The detecting unit 403 detects the swing of the other end portion 402*b* on the actuator 402. When the detecting unit 403 is, for example, a photo interrupter, the other end portion 402*b* on the actuator 402 forms a shade plate. A light-emitting element 403*a* and a light receiving portion 403*b*, which is located across the other end portion 402*b*, are located on the image forming apparatus 100 (the installation box 401) side. The other end portion 402*b* passes through between the light-emitting element 403*a* and the light receiving portion 403*b* while swinging. As illustrated in FIGS. 4A and 4B, when the paper sheets P are present at the sheet feed cassette 400, the paper sheets P push up the one end portion 402*a* to swing the other end portion 402*b* upward. When other end portion 402*b* passes through between the light-emitting element 403*a* and the light receiving portion 403*b*, the detecting unit 403 outputs an ON signal. If the paper sheets P are not present at the sheet feed cassette 400 any more, the one end portion 402*a* hangs downward to swing the other end portion 402*b* downward. By displacing the other end portion 402*b* from between the light-emitting element 403*a* and the light receiving portion 403*b*, the detecting unit 403 outputs an OFF signal.

Thus, with the sheet feed cassette 400 mounted to the installation box 401, by monitoring whether an signal finally output from the detecting unit 403 is the ON signal or the OFF signal, whether the paper sheets P are present at the sheet feed cassette 400 or not is detectable.

If the sheet feed cassette 400 is not appropriately mounted to the installation box 401, the paper sheets P fail to press up the one end portion 402*a*. Then, the detecting unit 403 outputs the OFF signal.

When putting in/taking out the sheet feed cassette 400, the detecting unit 403 (between the light-emitting element 403*a* and the light receiving portion 403*b*) does not detect the other end portion 402*b* on the actuator 402. Therefore, using the detecting unit 403, the open/close state of the sheet feed cassette of the sheet feed cassette 400 is detected.

For example, as illustrated in FIGS. 4A and 4B, a plurality of protrusions 404 are convexly installed in an asymmetric manner with respect to the putting-in/taking-out direction of this sheet feed cassette 400. The plurality of protrusions 404 are located at positions detectable by the detecting unit 403 and at the far-side in the putting-in/taking-out direction of the sheet feed cassette 400 with respect to the position of the other end portion 402*b* on the actuator 402. For example, the protrusions 404 are located by two. A first protrusion 404*a*, which has a convex shape with a specific size with respect to the putting-in/taking-out direction of the sheet feed cassette 400, is located on the near-side (close to the other end portion 402*b* on the actuator 402) in the putting-in/taking-out direction of the sheet feed cassette 400. A second protrusion 404*b*, which has a convex shape with a size larger than the size of the first protrusion 404*a* in the putting-in/taking-out direction, is located on the far-side in the putting-in/taking-out direction of the sheet feed cassette 400 providing a certain space t from the first protrusion 404*a*. Upon putting in or taking out the sheet feed cassette 400, the two protrusions 404*a* and 404*b* come and go between the light-emitting element 403*a* and the light receiving portion 403*b*. Then, the detecting unit 403 detects the passing of the two protrusions 404*a* and 404*b* when putting in or taking out the sheet feed cassette 400. When the two protrusions 404*a* and 404*b* pass through between the light-emitting element 403*a* and the light receiving portion 403*b*, the detecting unit 403 outputs the ON signal and the OFF signal corresponding to the convex shapes of the two protrusions 404*a* and 404*b*. The two protrusions 404*a* and 404*b* are convexly installed in the asymmetric manner with respect to the putting-in/taking-out direction. Therefore, changes in the ON signal and the OFF signal detected by the detecting unit 403 when extracting the sheet feed cassette 400 differs from changes in the ON signal and the OFF signal detected by the detecting unit 403 when the sheet feed cassette 400 is pushed to the inside. Monitoring these changes in the signals by the detecting unit 403 ensures determining whether the sheet feed cassette 400 is extracted and enters in the open state or the sheet feed cassette 400 is pushed into and enters in the closed state.

Next, the following describes specific procedure of monitoring the sheet feed cassette monitoring unit 105. First, a signal monitoring unit 203 (also referred to as a signal monitoring circuit) in a sheet feed cassette monitor unit 105 that receives notification from the control unit 201 of the image processing apparatus 100 monitors signals from the detecting unit 403 (FIG. 3: S101).

Here, for example, when the plurality of sheet feed cassettes 400 are present, the sheet feed cassettes 400 each include the actuators 402, the detecting units 403, and the protrusions 404. Thus, the signal monitoring unit 203 monitors signals from the detecting units 403 for the respective sheet feed cassettes 400.

Figure 5B:
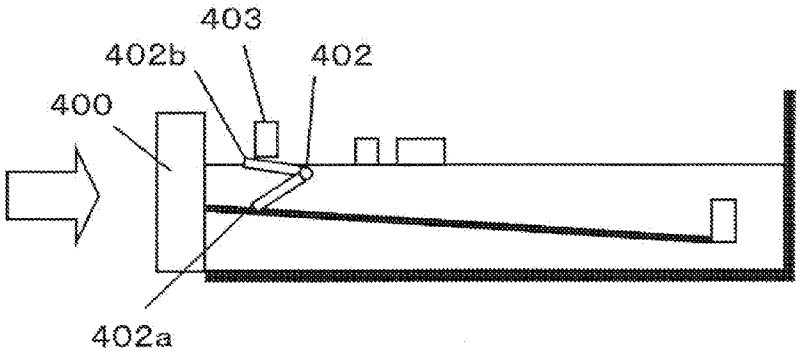
FIG. 5B illustrates an example of a cross section of a side surface of the sheet feed cassette when paper sheets have gone according to the one embodiment.
Figure 5A:
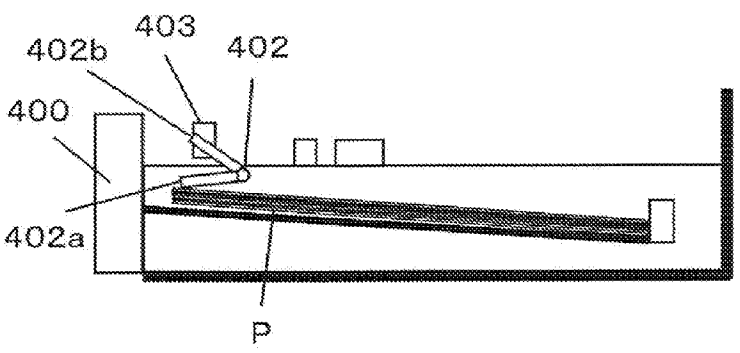
FIG. 5A illustrates an example of a cross section of a side surface of the sheet feed cassette when paper sheets are housed according to the one embodiment.

For example, as illustrated in FIG. 5A, when the specific sheet feed cassette 400 houses the paper sheets P, the detecting unit 403 detects the other end portion 402*b* on this actuator 402 with the one end portion 402*a* on the actuator 402. The signal monitoring unit 203 receives the ON signal from the detecting unit 403. Meanwhile, when the control unit 201 in the image processing apparatus 100 accepts a copy job from the user, a job execution unit 204 in the image processing apparatus 100 executes the copy job to convey the paper sheet P from the specific sheet feed cassette 400. As illustrated in FIG. 5B, when the paper sheets P become absent at the specific sheet feed cassette 400, the detecting unit 403 is displaced from the other end portion 402*b* on this actuator 402 with the one end portion 402*a* on the actuator 402, resulting in undetected. The signal monitoring unit 203 receives the OFF signal from the detecting unit 403.

Here, upon detection of the change in signal (FIG. 3: YES at S102), the signal monitoring unit 203 notifies a signal determining unit 205 (also referred to as a signal determining circuit) of the change. This notified signal determining unit 205 determines the presence/absence state of the paper sheets P housed at the specific sheet feed cassette 400 and the open/close state of this specific sheet feed cassette 400 based on a pattern of change in the signal (FIG. 3: S103).

Figure 5C:
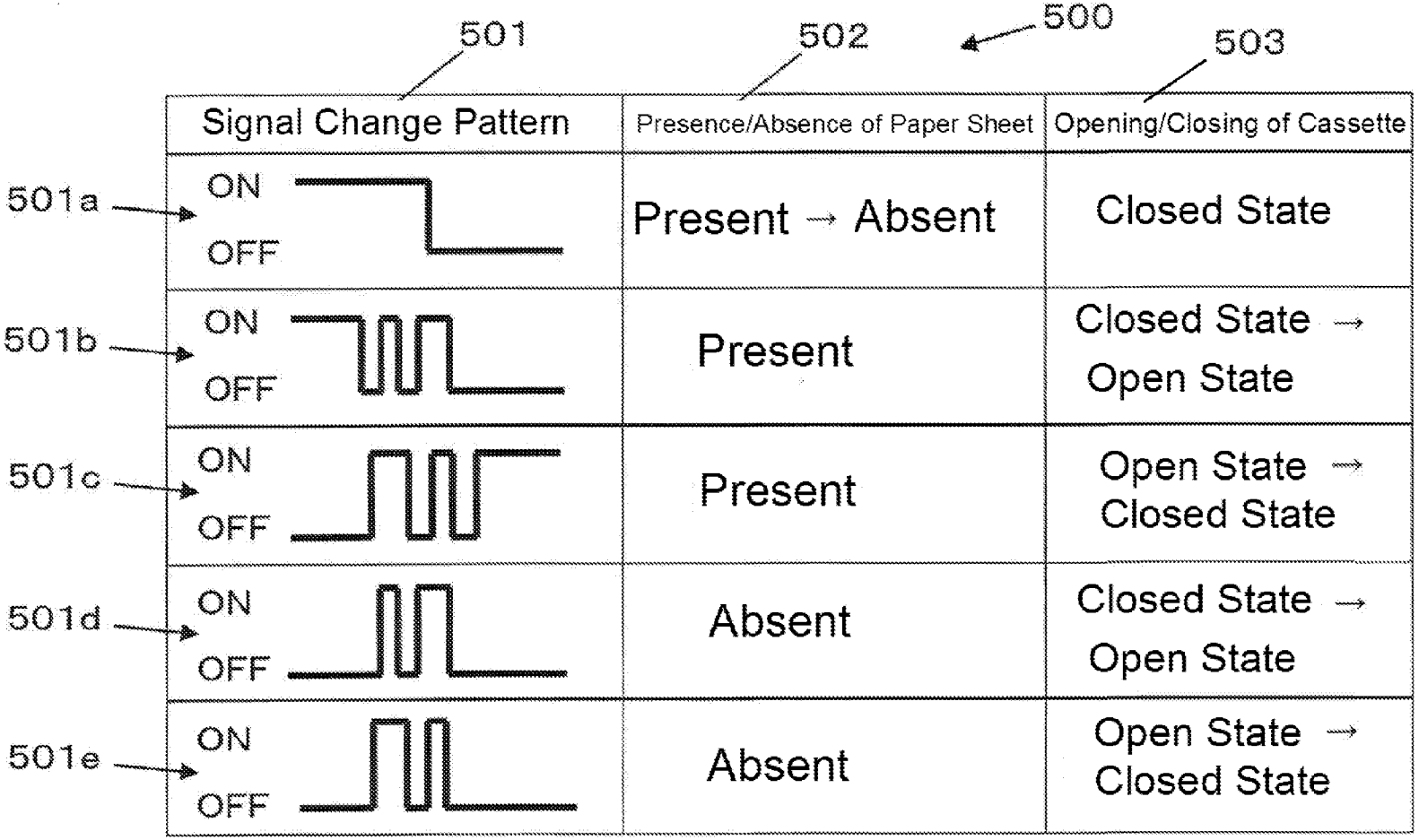
FIG. 5C illustrates an example of a signal change state table according to the one embodiment.

For example, when the signal determining unit 205 receives the pattern of changing from the ON signal to the OFF signal via the signal monitoring unit 203, the signal determining unit 205 refers to a signal change state table 500 stored in a specific memory. As illustrated in FIG. 5C, the signal change state table 500 is composed of a combination of the ON signals and the OFF signals from the detecting unit 403. The signal change state table 500 stores a plurality of signal change patterns 501 indicative of the patterns of changes in signals, a presence/absence state 502 of the paper sheets P at the specific sheet feed cassette 400, and an open/close state 503 of the specific sheet feed cassette 400, which are associated to one another. The signal determining unit 205 determines whether the pattern of change in the monitored (received) signal corresponds to any of the signal change patterns 501 in the signal change state table 500.

Here, with the closed state of the sheet feed cassette 400, when the paper sheets at this sheet feed cassette 400 have been conveyed and gone, the signal change pattern 501 of the signal change state table 500 simply changes from the ON signal to the OFF signal, keeping a first signal change pattern where the OFF signal is held as it is.

Therefore, when the pattern of change in the received signal corresponds to a first signal change pattern 501*a*, the signal determining unit 205 obtains the presence/absence state 502 (present→absent) of the paper sheets P and the open/close state 503 (the closed state) of the specific sheet feed cassette 400, which correspond to the first signal change pattern 501*a*. The signal determining unit 205 determines that the pattern of change in the receive signal indicates the state of the paper sheets P being absent and the sheet feed cassette 400 being in the closed state. The signal determining unit 205 notifies the display accepting unit 202 of the states. This notified display accepting unit 202 displays a paper sheet absence screen 600 on a touch panel corresponding to the result determination (FIG. 3: S104).

Figure 6A:
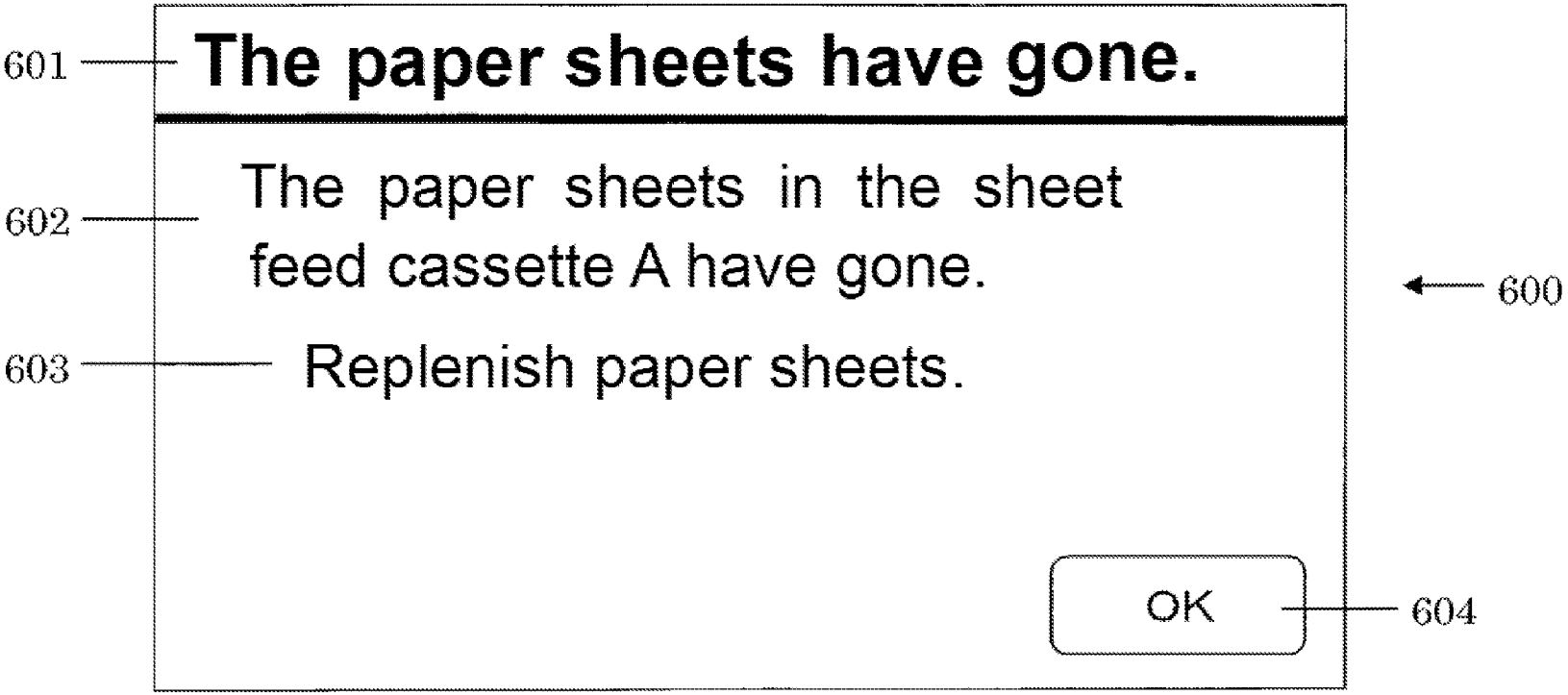
FIG. 6A illustrates an example of a paper sheet absence screen according to the one embodiment.

As illustrated in FIG. 6A, the paper sheet absence screen 600 displays a message 601, a message 602, a message 603, and an OK key 604. The message 601 is a message indicating that this displayed screen is the paper sheet absence screen. The message 602 is a message notifying that the paper sheets have gone from a sheet feed cassette A corresponding to the specific sheet feed cassette 400. The message 603 is a message of prompting the user to replenish paper sheets. This allows the user to confirm absence of the paper sheets at the specific sheet feed cassette 400.

Figure 7A:
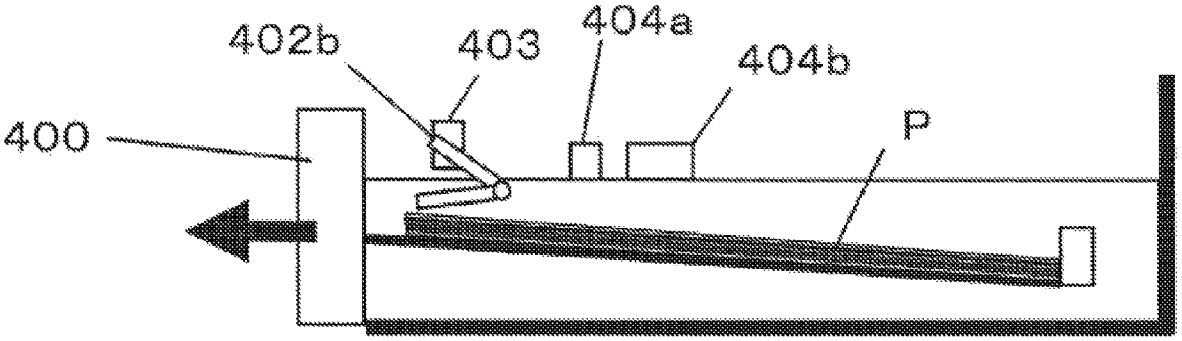
FIGS. 7A to 7D illustrate an example of cross sections of a side surface of the sheet feed cassette when the sheet feed cassette is extracted with the paper sheets present according to the one embodiment.
Figure 7B:
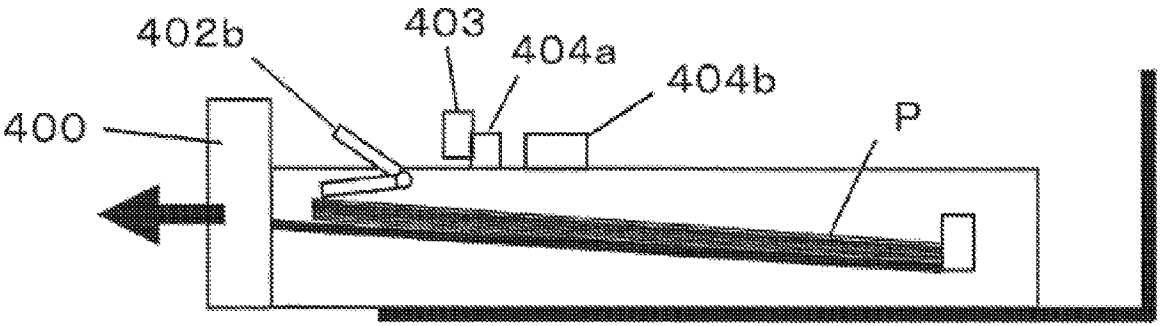
Figure 7C:
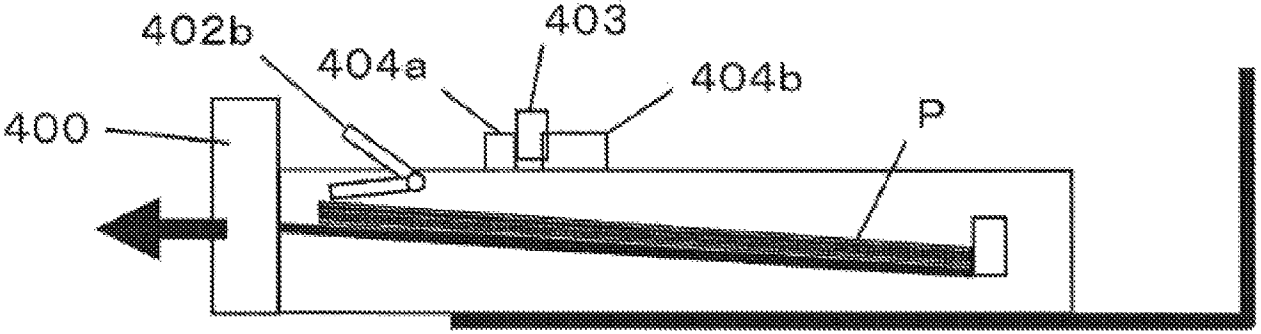
Figure 7D:
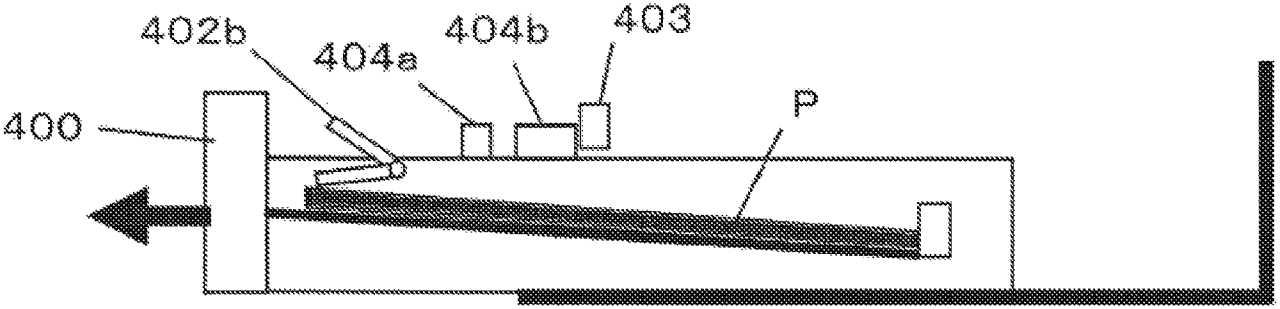
Figure 7E:
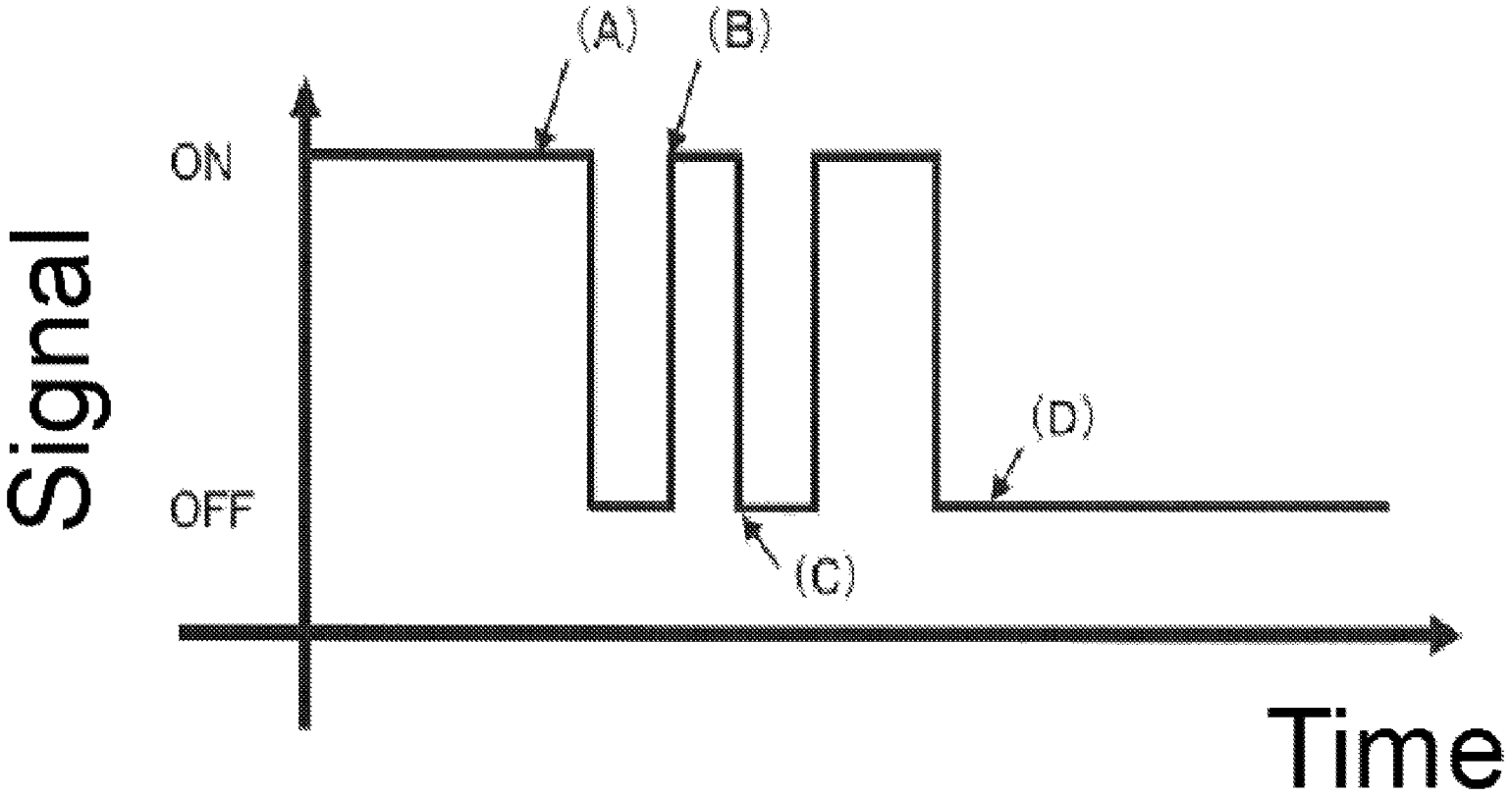
FIG. 7E illustrates an example of a pattern of change in a signal when the sheet feed cassette is extracted with the paper sheets present according to the one embodiment.

Next, as illustrated in FIG. 7A, with the paper sheets P housed in the sheet feed cassette 400, when the sheet feed cassette 400 is extracted, as illustrated in FIGS. 7B, 7C, and 7D, the detecting unit 403 does not detect the other end portion 402*b* on the actuator 402, which has been detected until now. The detecting unit 403 detects the two protrusions 404*a* and 404*b* in the order of the first protrusion 404*a* and the second protrusion 404*b*. Finally, the detecting unit 403 stops detecting these two protrusions 404*a* and 404*b*. Then, as illustrated in FIG. 7E, the signal change pattern 501 in the signal change state table 500 changes from the ON signal to the OFF signal. Next, the signal change pattern 501 changes in the order of: the ON signal corresponding to the first protrusion 404*a* on the near-side in the putting-in/taking-out direction of the sheet feed cassette 400, the OFF signal corresponding to the space t between the two protrusions 404*a* and 404*b*, the ON signal corresponding to the second protrusion 404*b*, and finally ending at the OFF signal. This pattern is a second signal change pattern.

When the pattern of change in the received signal corresponds to a second signal change pattern 501*b* in the signal change state table 500, the signal determining unit 205 obtains the presence/absence state 502 (present) of the paper sheets P and the open/close state 503 (closed state→open state) of the specific sheet feed cassette 400, which correspond to the second signal change pattern 501*b*. The signal determining unit 205 determines that the pattern of change in the receive signal indicates the state of the paper sheets P being present and the sheet feed cassette 400 being in the open state. Corresponding to the determination results, the display accepting unit 202 causes the touch panel to display a sheet feed cassette open state screen 605.

Figure 6B:
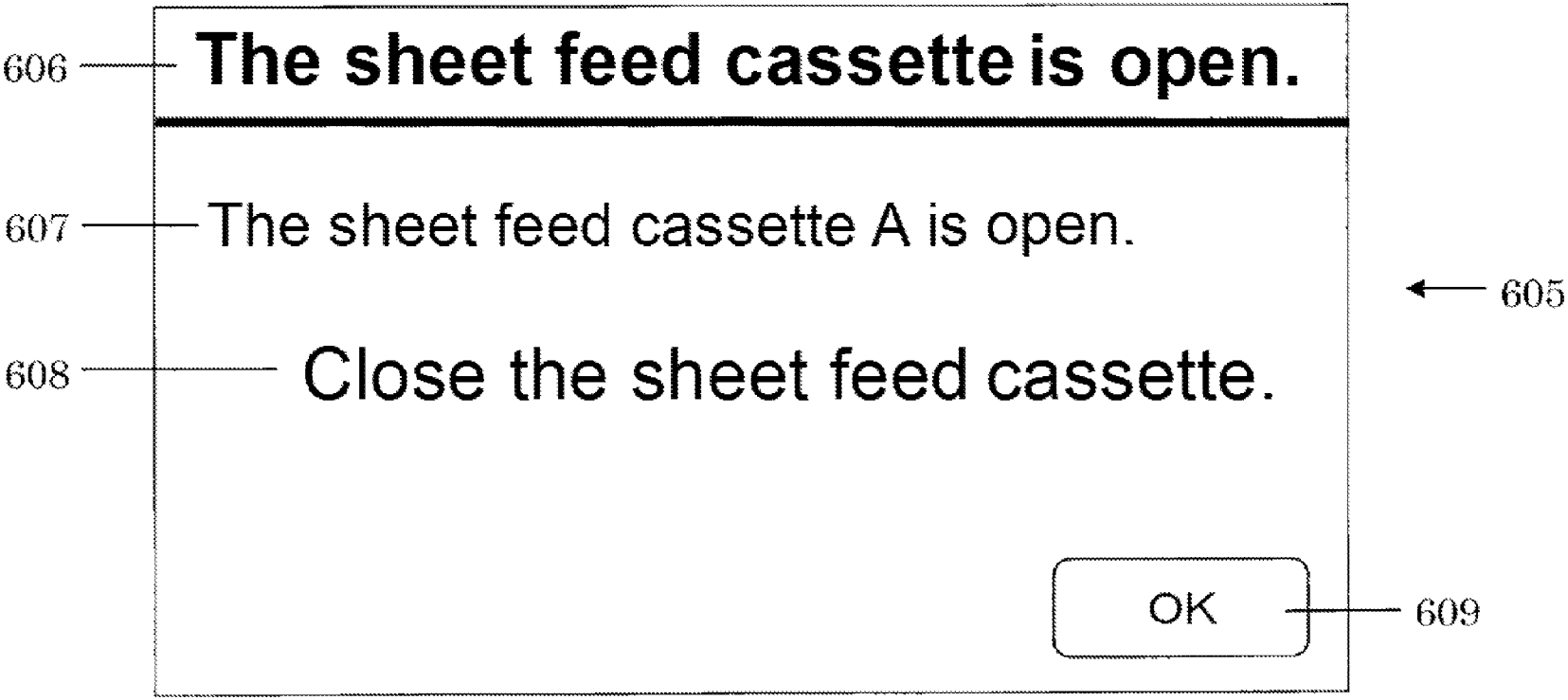
FIG. 6B illustrates an example of a sheet feed cassette open state screen according to the one embodiment.

As illustrated in FIG. 6B, the sheet feed cassette open state screen 605 displays a message 606, a message 607, a message 608, and an OK key 609. The message 606 is a message indicating that this displayed screen is the sheet feed cassette open state screen. The message 607 is a message indicating that the sheet feed cassette A corresponding to the specific sheet feed cassette 400 has been opened. The message 608 is a message prompting the user to close the sheet feed cassette A. This allows the user to confirm the open state of the specific sheet feed cassette 400.

Figure 8A:
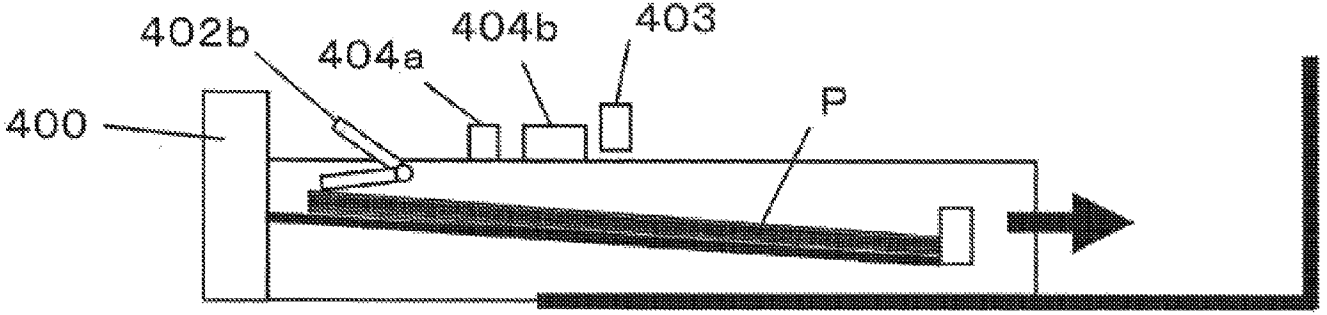
FIGS. 8A to 8D illustrate an example of cross sections of a side surface of the sheet feed cassette when the sheet feed cassette is pushed into with the paper sheets present according to the one embodiment.
Figure 8B:
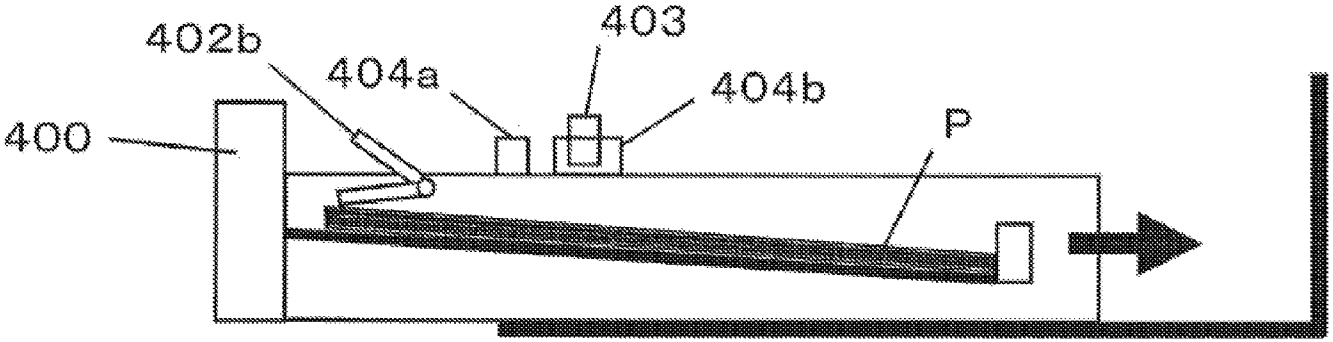
Figure 8C:
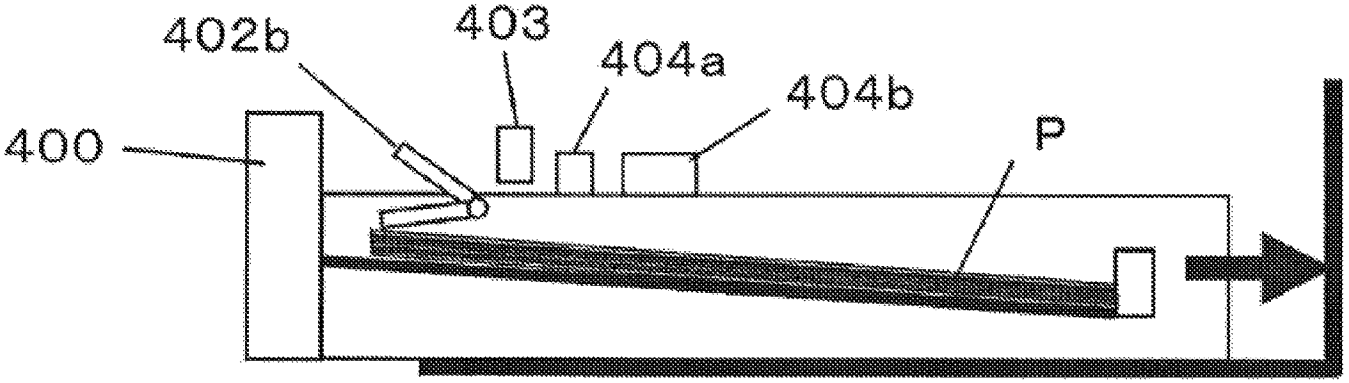
Figure 8D:
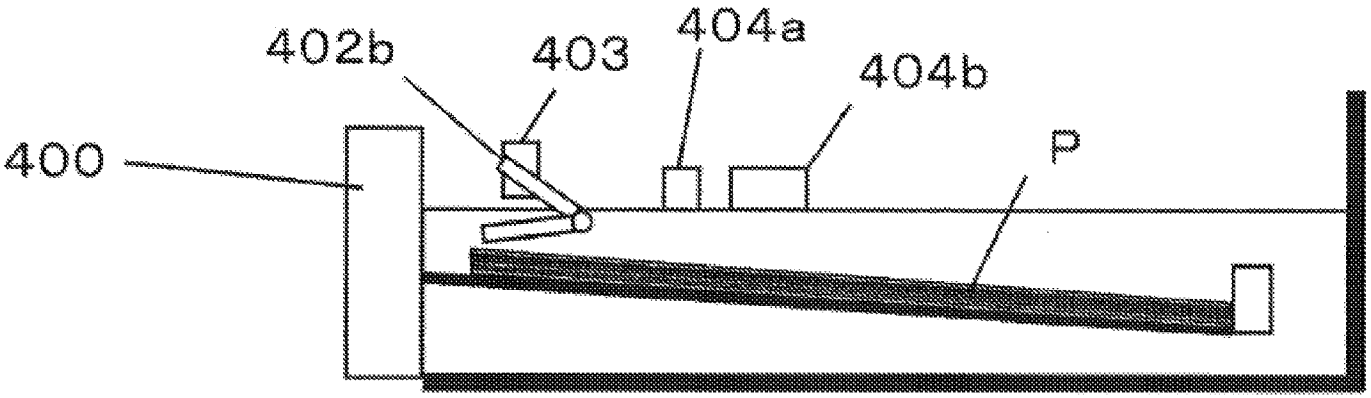
Figure 8E:
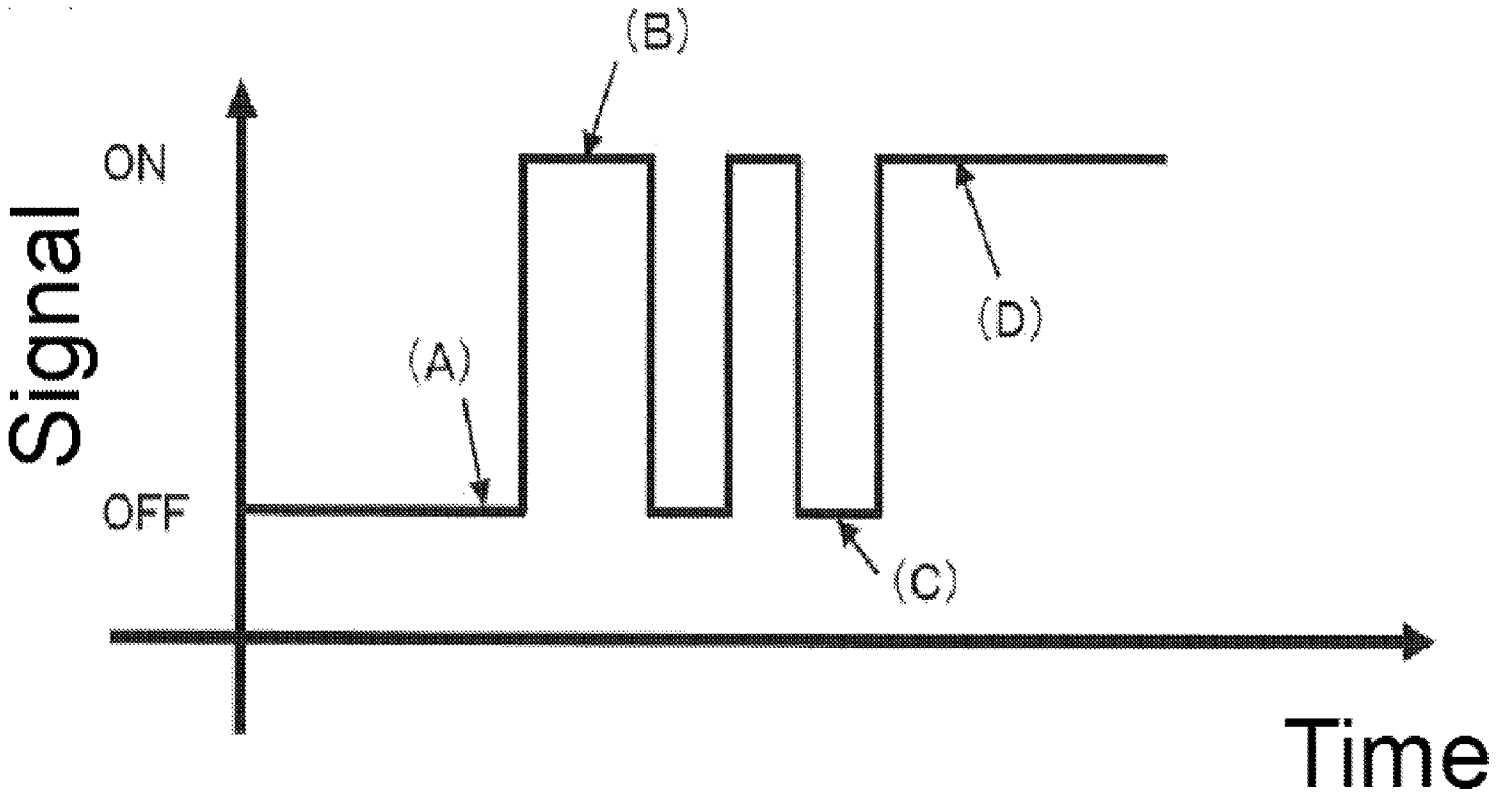
FIG. 8E illustrates an example of a pattern of change in a signal when the sheet feed cassette is pushed into with the paper sheets present according to the one embodiment.

Next, as illustrated in FIG. 8A, with the paper sheet P housed in the sheet feed cassette 400, when the sheet feed cassette 400 is pushed into from the extracted state (the open state), as illustrated in FIGS. 8B, 8C, and 8D, the detecting unit 403 detects the two protrusions 404*a* and 404*b*, which have been undetected until now, in the order of the second protrusion 404*b* and the first protrusion 404*a*. Finally, the detecting unit 403 detects the other end portion 402*b* on the actuator 402. Then, as illustrated in FIG. 8E, the signal change pattern 501 in the signal change state table 500 changes the OFF signal in the order of: the ON signal corresponding to the second protrusion 404*b* on the far-side in the putting-in/taking-out direction of the sheet feed cassette 400, the OFF signal corresponding to the space t between the two protrusions 404*a* and 404*b*, and the ON signal corresponding to the first protrusion 404*a*, and finally ending in the ON signal. This pattern is a third signal change pattern. The two protrusions 404*a* and 404*b* are convexly installed in the asymmetric manner with respect to the putting-in/taking-out direction of the sheet feed cassette 400. Therefore, when pushing the sheet feed cassette 400 inside, periods (pulse widths) during which the ON signals corresponding to the two protrusions 404*a* and 404*b* are held in the signal change pattern clearly differ from those in the signal change pattern when the sheet feed cassette 400 is extracted. This ensures clearly distinguishing both.

When the pattern of change in the received signal corresponds to a third signal change pattern 501*c* in the signal change state table 500, the signal determining unit 205 obtains the presence/absence state 502 (present) of the paper sheets P and the open/close state 503 (open state→closed state) of the specific sheet feed cassette 400, which correspond to the third signal change pattern 501*c*. The signal determining unit 205 determines that the pattern of change in the receive signal indicates the state of the paper sheets P being present and the sheet feed cassette 400 being in the closed state. The display accepting unit 202 performs a process corresponding to the determination result. For example, when the display accepting unit 202 has already caused the touch panel to display the sheet feed cassette open state screen 605, the display accepting unit 202 causes the touch panel to clear this sheet feed cassette open state screen 605.

Figure 9A:
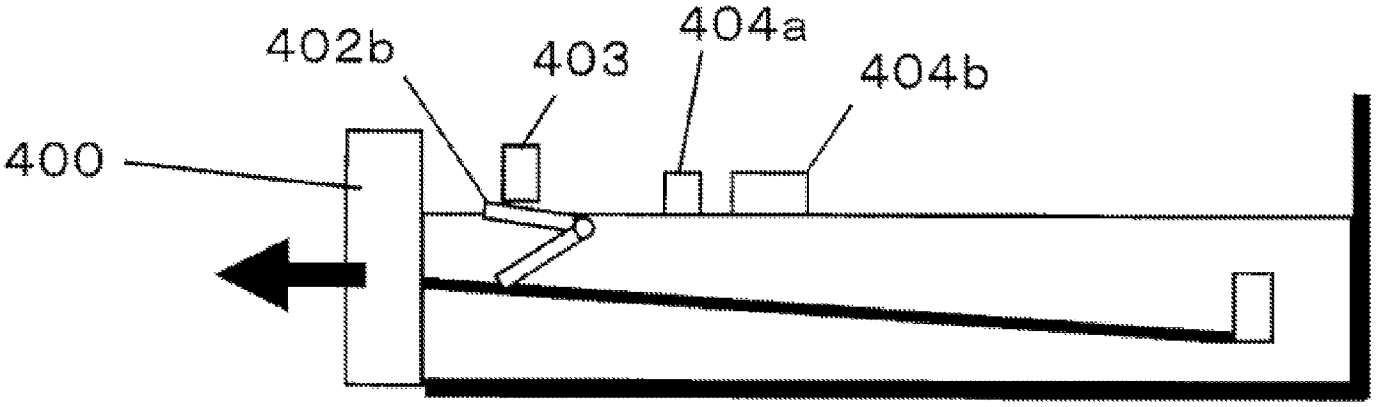
FIGS. 9A to 9D illustrate an example of cross sections of a side surface of the sheet feed cassette when the sheet feed cassette is extracted with the paper sheets absent according to the one embodiment.
Figure 9B:
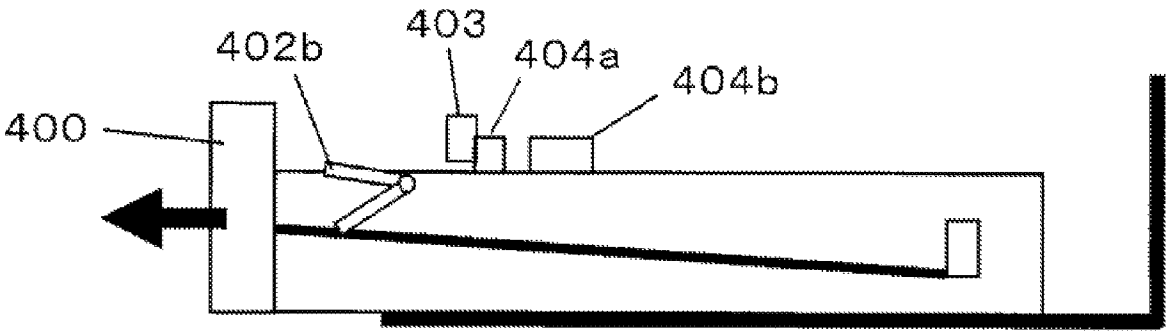
Figure 9C:
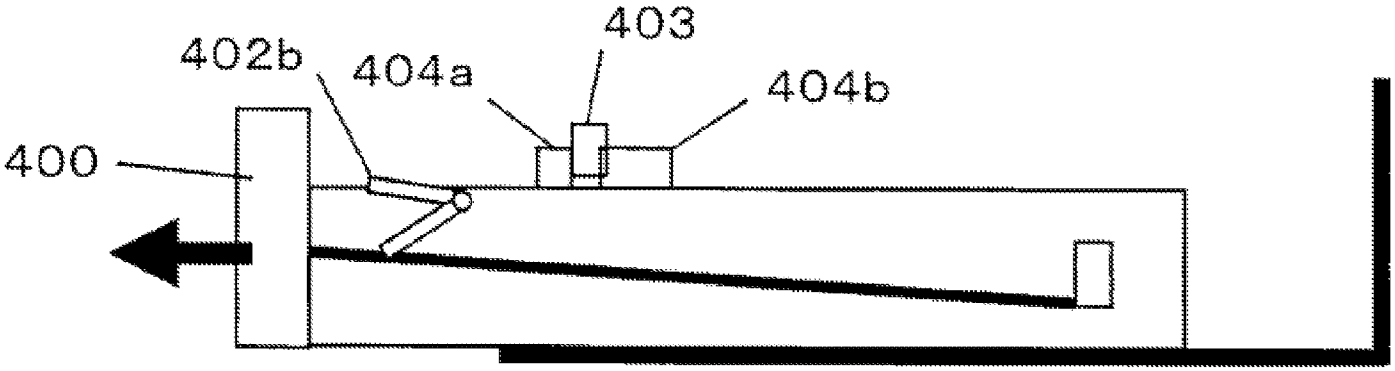
Figure 9D:
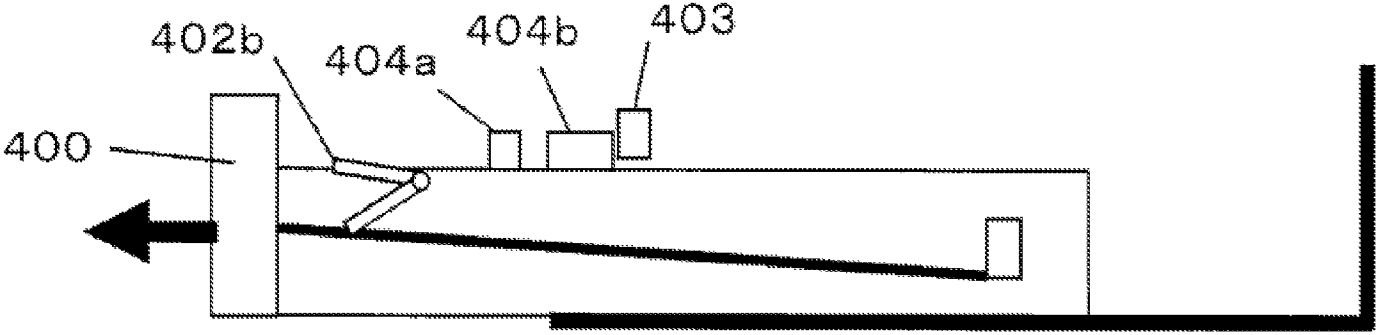
Figure 9E:
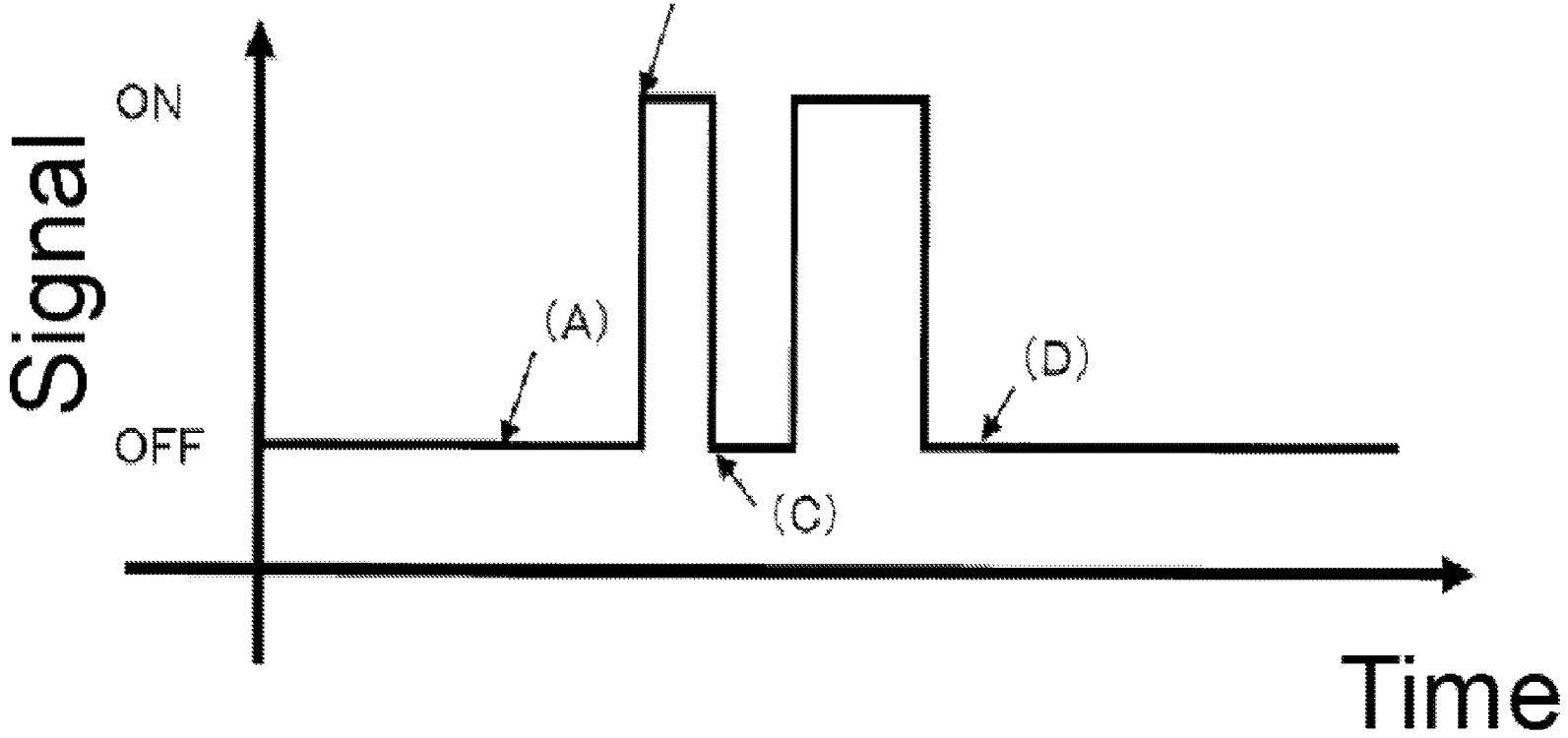
FIG. 9E illustrates an example of a pattern of change in a signal when the sheet feed cassette is extracted with the paper sheets absent according to the one embodiment.

As illustrated in FIG. 9A, with the paper sheets P absent at the sheet feed cassette 400, when extracting the sheet feed cassette 400, as illustrated in FIGS. 9B, 9C, and 9D, the detecting unit 403 detects the two protrusions 404*a* and 404*b*, which have been undetected until now, in the order of the first protrusion 404*a* and the second protrusion 404*b*. Finally, these two protrusions 404*a* and 404*b* are not detected. Then, as illustrated in FIG. 9E, the signal change pattern 501 in the signal change state table 500 changes from the OFF signal in the order of: the ON signal corresponding to the first protrusion 404*a*, the OFF signal corresponding to the space t between the two protrusions 404*a* and 404*b*, the ON signal corresponding to the second protrusion 404*b*, and finally ending at the OFF signal. This pattern is a fourth signal change pattern.

Therefore, when the pattern of change in the received signal corresponds to a fourth signal change pattern 501*d* in the signal change state table 500, the signal determining unit 205 obtains the presence/absence state 502 (absent) of the paper sheets P and the open/close state 503 (closed state→open state) of the specific sheet feed cassette 400, which correspond to the fourth signal change pattern 501*d*. The signal determining unit 205 determines that the pattern of change in the receive signal indicates the state of the paper sheets P being absent and the sheet feed cassette 400 being in the open state. Corresponding to the determination results, for example, the display accepting unit 202 causes the touch panel to display the paper sheet absence screen 600 and the sheet feed cassette open state screen 605.

Figure 10A:
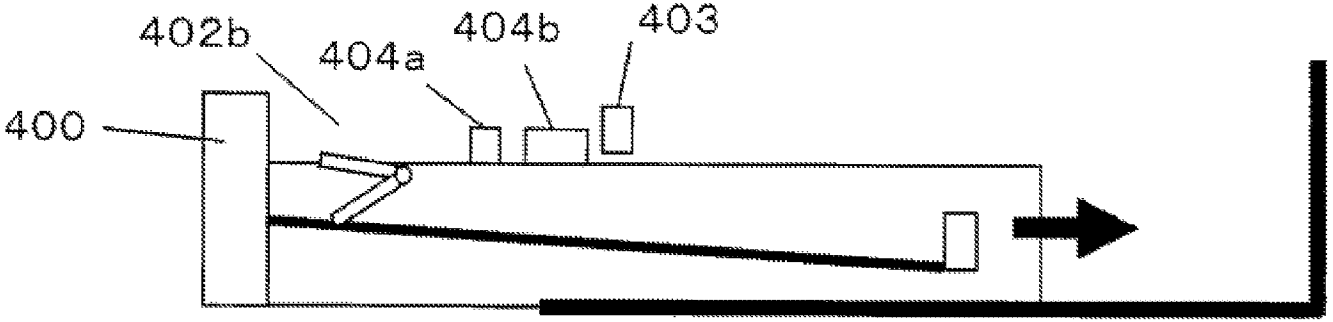
FIGS. 10A to 10D illustrate an example of cross sections of a side surface of the sheet feed cassette when the sheet feed cassette is pushed into with the paper sheets absent according to the one embodiment.
Figure 10B:
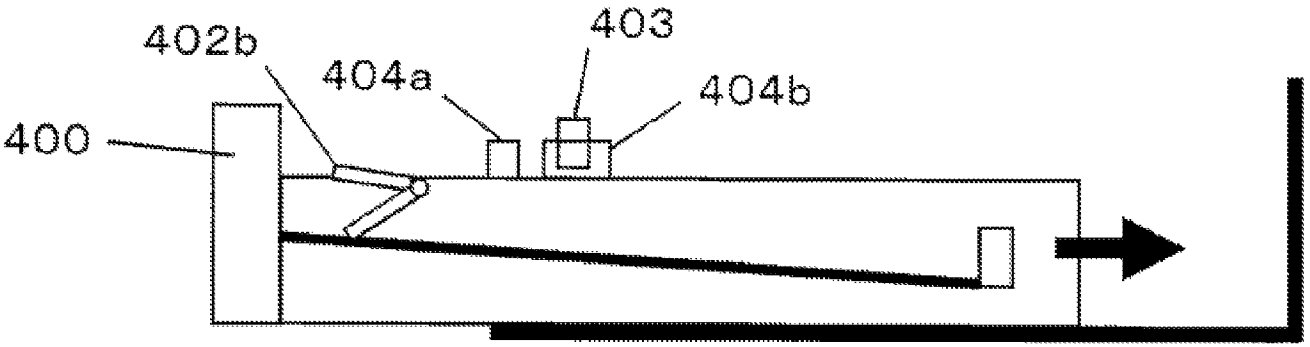
Figure 10C:
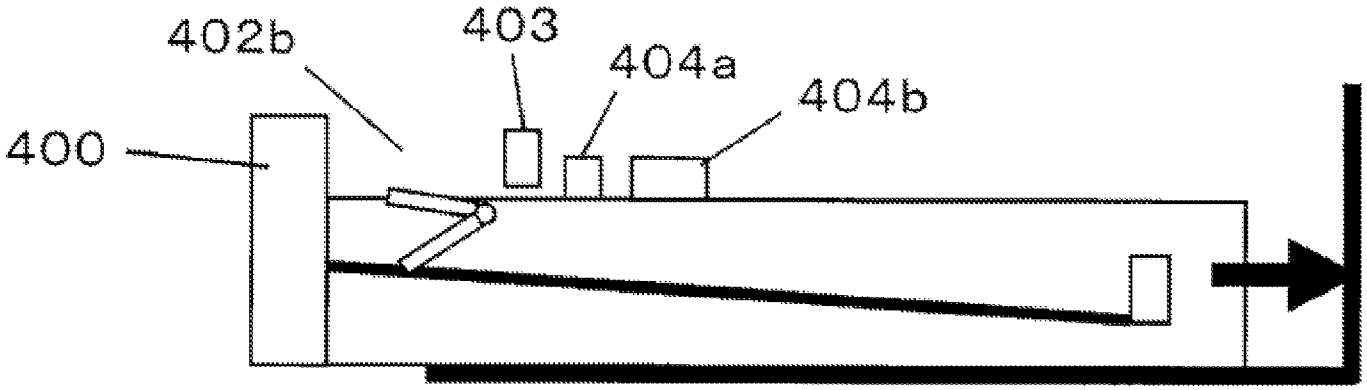
Figure 10D:
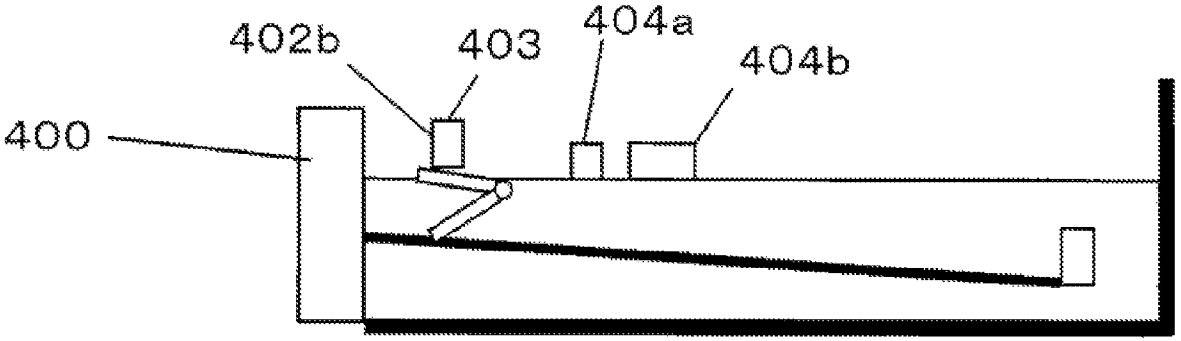
Figure 10E:
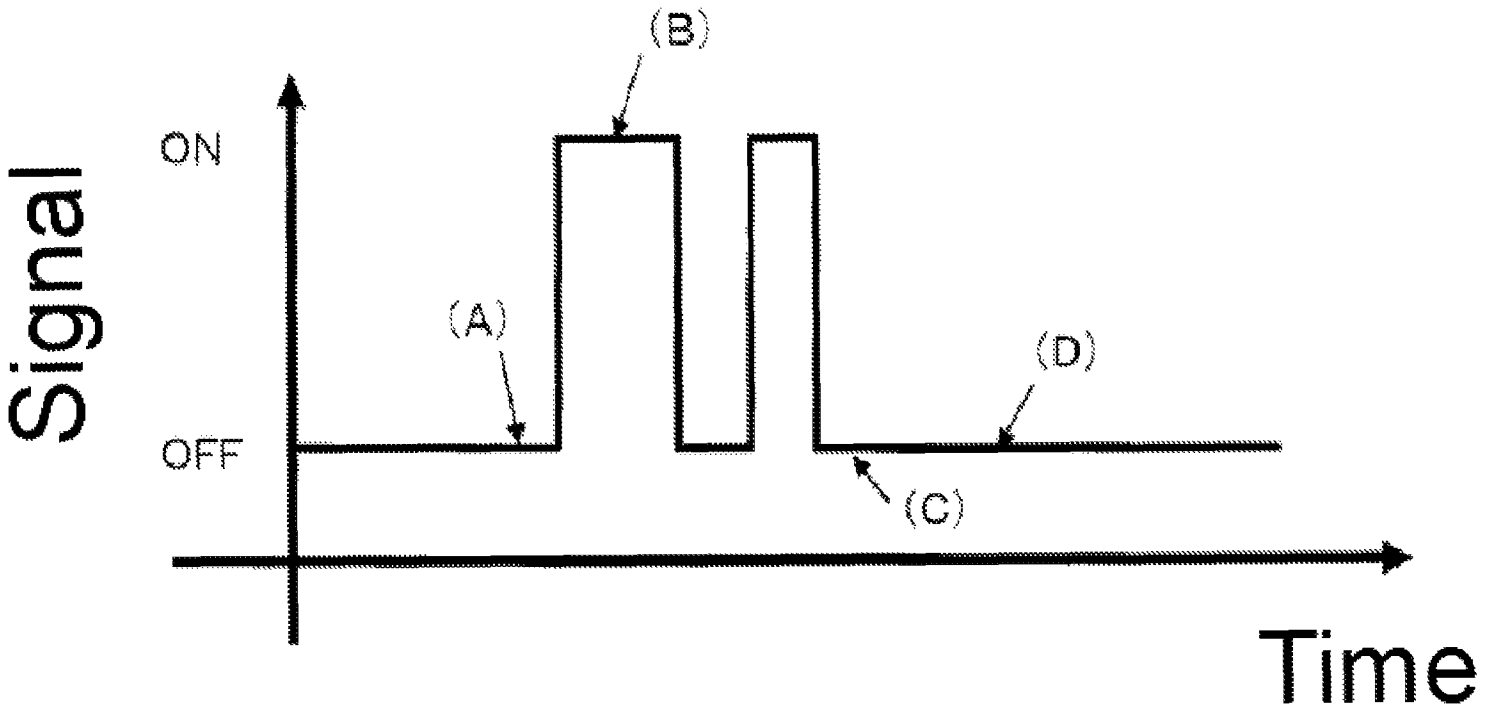
FIG. 10E illustrates an example of a pattern of change in a signal when the sheet feed cassette is pushed into with the paper sheets absent according to the one embodiment.

As illustrated in FIG. 10A, with the paper sheets P absent at the sheet feed cassette 400, when the sheet feed cassette 400 is pushed inside, as illustrated in FIGS. 10B, 10C, and 10D, the detecting unit 403 detects the two protrusions 404*a* and 404*b*, which have been undetected until now, in the order of the second protrusion 404*b* and the first protrusion 404*a*. Finally, these two protrusions 404*a* and 404*b* are not detected. Then, as illustrated in FIG. 10E, the signal change pattern 501 in the signal change state table 500 changes from the OFF signal in the order of: the ON signal corresponding to the second protrusion 404*b*, the OFF signal corresponding to the space t between the two protrusions 404*a* and 404*b*, the ON signal corresponding to the first protrusion 404*a*, and finally ending at the OFF signal. This pattern is a fifth signal change pattern.

When the pattern of change in the received signal corresponds to a fifth signal change pattern 501*e* in the signal change state table 500, the signal determining unit 205 obtains the presence/absence state 502 (absent) of the paper sheets P and the open/close state 503 (open state→closed state) of the specific sheet feed cassette 400, which correspond to the fifth signal change pattern 501*e*. The signal determining unit 205 determines that the pattern of change in the receive signal indicates the state of the paper sheets P being absent and the sheet feed cassette 400 being in the closed state. Corresponding to the determination results, the display accepting unit 202, for example, displays the paper sheet absence screen 600.

Thus, the disclosure ensures highly accurately detecting the open/close state of the sheet feed cassette and the presence/absence state of the paper sheet by the one detecting unit 403 (IP) and with the simple configuration of logic values. Additionally, since the one detecting unit 403 is sufficient, costs taken for other sensors, wiring, substrate connectors, circuits, or similar components, the number of used CPU ports for another sensors, and power consumption for other sensors can be reduced. This ensures reducing the total cost.

With the embodiment of the disclosure, the photo interrupter of the detecting unit 403 is a transmissive sensor; however, a reflective sensor may be employed.

The embodiment of the disclosure includes the two protrusions 404. However, as long as the protrusions 404 are convexly installed in an asymmetric manner with respect to the putting-in/taking-out direction of the sheet feed cassette 400 so as to distinguish the putting-in and taking out of the sheet feed cassette 400, the protrusions 404 may be three or more.

With the embodiment of the disclosure, the signal determining unit 205 receives the monitored signal when necessary and determines whether the pattern of change in this monitored signal corresponds to any of the signal change patterns in the signal change state table or not when necessary. That is, the signal determining unit 205 discards the change in the signals monitored in the past and uses the pattern of change in the signal newly monitored. For example, assume the case where the monitored signal irregularly changes due to some sort of reason, such as power-on of the apparatus while the user extracts the sheet feed cassette 400. Although the signal determining unit 205 once determines the pattern of change in the irregular signal, the signal determining unit 205 performs a process the pattern determining that this irregular pattern of change in the signal does not correspond to any of the signal change patterns in the signal change state table. The signal determining unit 205 receives the pattern of change in the newly monitored signal and determines whether this pattern of change in the monitored signal corresponds to any of the signal change patterns in the signal change state table or not. Thus, discarding the pattern of change in the irregular signal ensures highly accuracy detecting the open/close state of the sheet feed cassette 400 and the presence/absence state of the paper sheet P.

The embodiment of the disclosure configures the sheet feed cassette monitoring unit 105 so as to include the respective units. However, the image forming apparatus may include the respective units.

The embodiment of the disclosure configures that the sheet feed cassette monitoring unit 105 includes the respective units. However, a storage medium may store a program achieving these respective units, and this storage medium may be provided. With this configuration, the apparatus reads the program to achieve the respective units by the apparatus. In this case, the program read from the recording medium itself provides operational advantages of the disclosure. Furthermore, a method that causes a hard disk to store steps performed by the respective units can also be provided.

As described above, the sheet feed cassette monitor, the image forming apparatus, and the sheet feed cassette monitoring method according to the disclosure are effective to a paper sheet conveying device, an image processing apparatus, an image forming apparatus, an electronic device, or a similar apparatus or a device. Although the configuration is simple, the disclosure is effective as a sheet feed cassette monitor, an image forming apparatus, and a sheet feed cassette monitoring method that ensure highly accurately detecting the open/close state of the sheet feed cassette and the presence/absence state of the paper sheet.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A sheet feed cassette monitor for monitoring a sheet feed cassette, comprising:

an actuator that includes one end portion and another end portion, the one end portion being in contact with an uppermost layer of paper sheets housed in the sheet feed cassette, when the one end portion is in contact with the paper sheet with the sheet feed cassette placed in an installation box, the other end portion swinging in a first direction, when the one end portion is not in contact with the paper sheet, the other end portion swinging in a second direction, the second direction being a direction opposite to the first direction;

a detecting circuit including emitting and receiving elements located alongside the installation box, disposed across from each other with the other end portion of the actuator in between, such as to enable the detecting circuit to detect the swinging of the other end portion of the actuator;

a plurality of protrusions protrudingly installed on the sheet feed cassette, in an asymmetric manner with respect to disposed at a predetermined spacing along a putting-in/taking-out direction of the sheet feed cassette, depth-ward in the putting-in/taking-out direction of the sheet feed cassette of the location of the other end portion on the actuator, and differing from each other in size along the putting-in/taking-out direction of the sheet feed cassette such as to come and go between the emitting and receiving elements and be detected by the detecting circuit when the sheet feed cassette is put in or taken out of the installation box;

a signal monitoring circuit that monitors a signal from the detecting circuit; and a signal determining circuit that determines a presence/absence state of the paper sheet housed in the sheet feed cassette and an open/close state of the sheet feed cassette based on a pattern of change in the monitored signal.

2. The sheet feed cassette monitor according to claim 1, further comprising:

a signal change state table constituted of a combination of ON signals and OFF signals from the detecting unit, the signal change state table storing a plurality of signal change patterns indicative of the patterns of changes in the signal, the presence/absence state of the paper sheet at the sheet feed cassette, and the open/close state of the sheet feed cassette, the plurality of signal change patterns, the presence/absence state, and the open/close state being associated to one another; wherein the signal determining circuit determines whether the pattern of change in the monitored signal corresponds to any of the signal change patterns in the signal change state table, when the pattern of change in the monitored signal corresponds to a specific signal change pattern, the signal determining circuit obtaining the presence/absence state of the paper sheet at the sheet feed cassette and the open/close state of the sheet feed cassette corresponding to the specific signal change pattern to determine the presence/absence state of the paper sheet and the open/close state of the sheet feed cassette.

3. The sheet feed cassette monitor according to claim 1, further comprising a display accepting circuit that causes an operation unit to display a specific screen corresponding to a result of the determination.

4. An image forming apparatus, comprising:

a sheet feed cassette;

an actuator that includes one end portion and another end portion, the one end portion being in contact with an uppermost layer of paper sheets housed in the sheet feed cassette, when the one end portion is in contact with the paper sheet with the sheet feed cassette placed in an installation box, the other end portion swinging in a first direction, when the one end portion is not in contact with the paper sheet, the other end portion swinging in a second direction, the second direction being a direction opposite to the first direction;

a detecting circuit including emitting and receiving elements located alongside the installation box, disposed across from each other with the other end portion of the actuator in between, such as to enable the detecting circuit to detect the swinging of the other end portion of the actuator;

a plurality of protrusions protrudingly installed on the sheet feed cassette, in an asymmetric manner with respect to disposed at a predetermined spacing along a putting-in/taking-out direction of the sheet feed cassette, depth-ward in the putting-in/taking-out direction of the sheet feed cassette of the location of the other end portion on the actuator, and differing from each other in size along the putting-in/taking-out direction of the sheet feed cassette such as to come and go between the emitting and receiving elements and be detected by the detecting circuit when the sheet feed cassette is put in or taken out of the installation box;

a signal monitoring circuit that monitors a signal from the detecting circuit; and a signal determining circuit that determines a presence/absence state of the paper sheet housed in the sheet feed cassette and an open/close state of the sheet feed cassette based on a pattern of change in the monitored signal.

5. A sheet feed cassette monitoring method, comprising:

preparing an actuator that includes one end portion and another end portion, the one end portion being in contact with an uppermost layer of paper sheets housed in the sheet feed cassette, when the one end portion is in contact with the paper sheet with the sheet feed cassette placed in to an installation box, the other end portion swinging in a first direction, when the one end portion is not in contact with the paper sheet, the other end portion swinging in a second direction, the second direction being a direction opposite to the first direction;

detecting the swinging of the other end portion on the actuator alongside the installation box;

preparing plurality of protrusions protrudingly installed on the sheet feed cassette, in an asymmetric manner with respect to disposed at a predetermined spacing along a putting-in/taking-out direction of the sheet feed cassette, depth-ward in the putting-in/taking-out direction of the sheet feed cassette of the location of the other end portion on the actuator, and differing from each other in size along the putting-in/taking-out direction of the sheet feed cassette such as to come and go between the emitting and receiving elements and be detected by the detecting circuit when the sheet feed cassette is put in or taken out of the installation box;

monitoring a signal by the detecting of the swinging of the other end portion on the actuator; and determining a presence/absence state of the paper sheet housed in the sheet feed cassette and an open/close state of the sheet feed cassette based on a pattern of change in the monitored signal.

* * * * *